US006092845A

United States Patent [19]

Koenig

[11] Patent Number: 6,092,845

[45] Date of Patent: Jul. 25, 2000

[54] HOOD LATCH AND RELEASE MECHANISM AND OPERATING SYSTEM INCLUDING SAME

[75] Inventor: Peter C. Koenig, Moberly, Mo.

[73] Assignee: Dura Automotive Systems, Inc., Rochester Hills, Mich.

[21] Appl. No.: 09/007,421

[22] Filed: Jan. 15, 1998

Related U.S. Application Data

[60] Provisional application No. 60/035,585, Jan. 17, 1997.

[51] Int. Cl.[7] ..... E05C 3/16

[52] U.S. Cl. ..... 292/225; 292/DIG. 43

[58] Field of Search ..... 292/28, 50, 125, 292/133, 225, 235, DIG. 14, DIG. 43, 216, DIG. 62

[56] References Cited

U.S. PATENT DOCUMENTS

| | | | |
|---|---|---|---|
| 1,929,371 | 10/1933 | Hamilton . | |
| 2,183,621 | 12/1939 | Peterson . | |
| 2,199,467 | 5/1940 | Saunders . | |
| 4,054,307 | 10/1977 | Carella | 295/50 |
| 4,273,368 | 6/1981 | Tanaka | 292/53 |
| 4,331,353 | 5/1982 | Yazawa et al. | 292/28 |
| 4,374,597 | 2/1983 | Mochida | 292/8 |
| 4,459,834 | 7/1984 | Seki | 70/256 |
| 4,875,350 | 10/1989 | Faust | 70/241 |
| 5,535,608 | 7/1996 | Brin | 70/256 |
| 5,647,234 | 7/1997 | Foster | 70/256 |

*Primary Examiner*—B. Dayoan
*Assistant Examiner*—Gary Estremsky
*Attorney, Agent, or Firm*—D. D. McGraw

[57] ABSTRACT

A vehicle hood latch and release mechanism is latched when the hood striker engages the latch portion of the mechanism as the hood is moved to its closed position. The mechanism is actuated to release the hood striker by a pushing action on the cable or strand movable in the sheath of a cable assembly rather than by the typical pulling action on current hood releasing mechanisms. The pushing action is obtained with actuation of a hood latching and releasing control, by movement of a handle which operatively pushes on the cable or strand, transmitting a longitudinally compressive force rather than a longitudinally tensional force to the latch mechanism and moving that mechanism to the striker-released position. Release of the control permits one or more springs to cause the control handle to be returned to its position wherein the latching and release mechanism is ready to again be latched to the hood striker. The handle is also in this position when the latching mode of the hood latching and releasing mechanism latches the hood striker to hold the hood closed. Modifications of the hood latching and releasing control are disclosed.

6 Claims, 4 Drawing Sheets

HOOD LATCH AND RELEASE MECHANISM AND OPERATING SYSTEM INCLUDING SAME

CROSS-REFERENCE TO RELATED APPLICATION

Claim of priority and benefit of earlier,filing date:

The inventor of this United States Patent Application filed under 35 U.S.C. 111(*a*) hereby claims priority of United States Provisional Application Ser. No. 60/035,585 filed Jan. 17, 1997, by the applicant Peter C. Koenig, Moberly, Mo., who is the inventor named in this United States Patent Application as the inventor of the invention herein disclosed and claimed. The above-identified Provisional Application was also assigned to the same assignee as the assignee of the invention disclosed and claimed herein. The above-identified Provisional Application fully complies with 35 U.S.C. 119(e)(2).

BACKGROUND OF THE INVENTION

1. Field of the Invention

The invention relates to an improved hood latch and release mechanism and related apparatus for operating the mechanism which together provide an improved hood latch and release system.

2. Description of the Related Art

Hood latch and release mechanisms (hereinafter referred to as hood latches or hood latch mechanisms) are employed conventionally in automobiles, trucks, tractor-trailers, among other apparatus for securing one or more compartments. Conventional hood latches are widely used in automobiles and trucks to maintain the hood in a closed position as well as to provide security for the engine compartment. These hood latches can be released by pulling a lever or rod within the passenger compartment that in turn releases the latch, thereby permitting the hood to be opened. The lever or rod is functionally connected to the hood latch by a cable assembly which comprises a sheath or conduit having a cable or strand which is longitudinally movable in the sheath under tension. Actuation of the lever or rod exerts a tension force through the cable, pulling on and actuating the latch release mechanism.

Conventional hood latch mechanisms can often be operated in an unintended manner by manually pulling on the cable assembly via access from underneath the vehicle or through the front grill of the vehicle, which in turn pulls the strand and releases the latch mechanism. Such unintended release operation of the hood latch unfortunately allows unauthorized access to the engine and its components as well as several other components of the vehicle, presenting the opportunity for theft and vandalism. Consequently, there is a need in this art for an improved hood latch mechanism which eliminates unauthorized access to the engine compartment and theft of vehicle components or the entire vehicle by eliminating the ability to pull on the cable or strand so as to unlatch the hood latch mechanism.

BRIEF SUMMARY OF THE INVENTION

The invention herein disclosed and claimed solves problems associated with conventional hood latches and their release operating apparatus by providing an improved hood latch mechanism having a latch release system which is actuated by application of a compressive force. By pushing the cable or strand into the latch, a release arm or lever is rotated about a pivot, thereby permitting movement of a striker latching bolt and resulting in withdrawal of the striker from the hood latch, releasing the latch.

BRIEF DESCRIPTION OF THE DRAWINGS

FIG. 4 is also in this position when the hood latch mechanism is in the ready-to-engage position of FIG. 1.

FIG. 7 is also in this position when the hood latch mechanism is in e ready-to-engage position of FIG. 1.

DETAILED DESCRIPTION OF THE INVENTION

Figure 1:
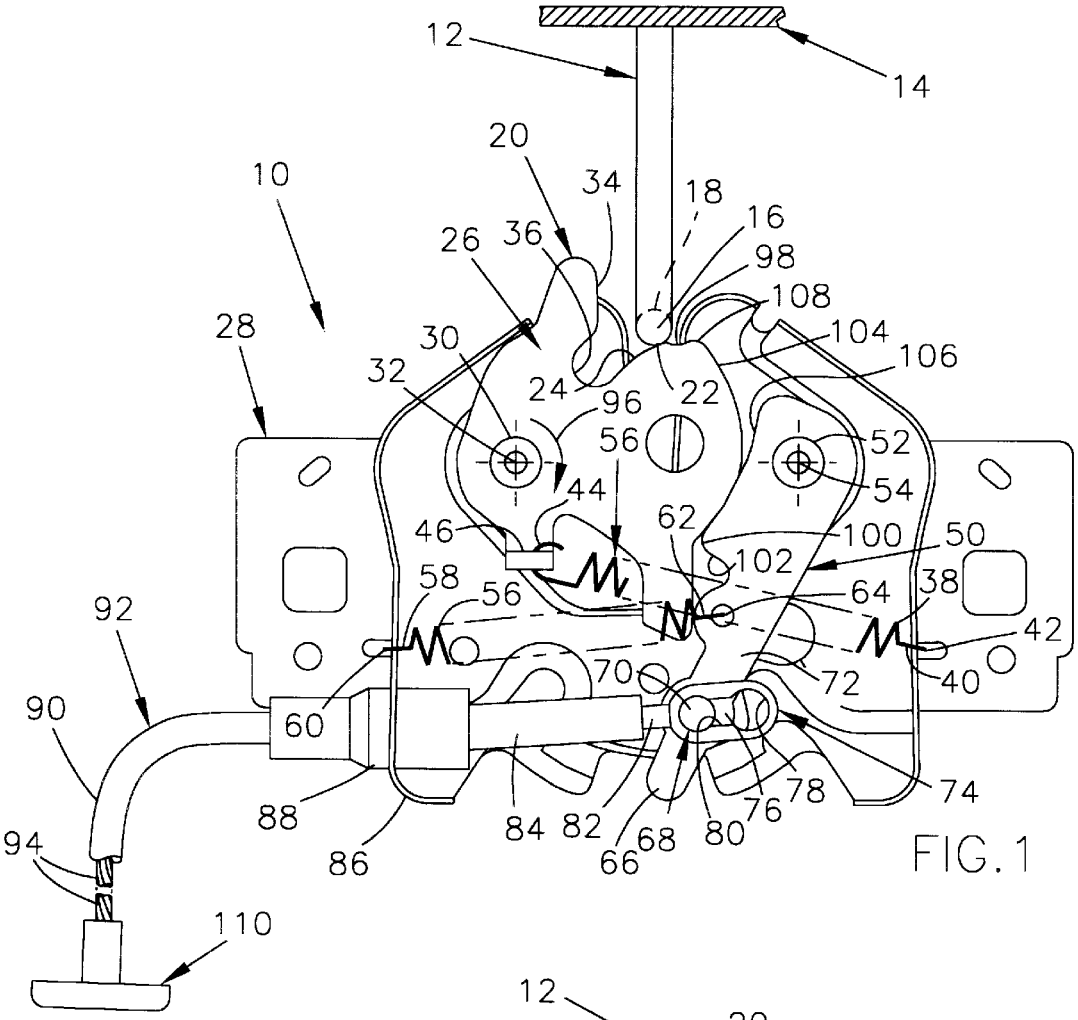
FIG. 1 is an side elevation view, with parts broken away and in section, from the perspective wherein the hood latch and release mechanism portion of the system is seen from a vantage point within the vehicle engine compartment normally covered by the engine compartment hood, with a cable or strand schematically shown as being within a sheath or conduit and as being connected to the schematically shown release handle of the system. The latch mechanism is shown in the ready-to latch or ready-to-engage position.
Figure 2:
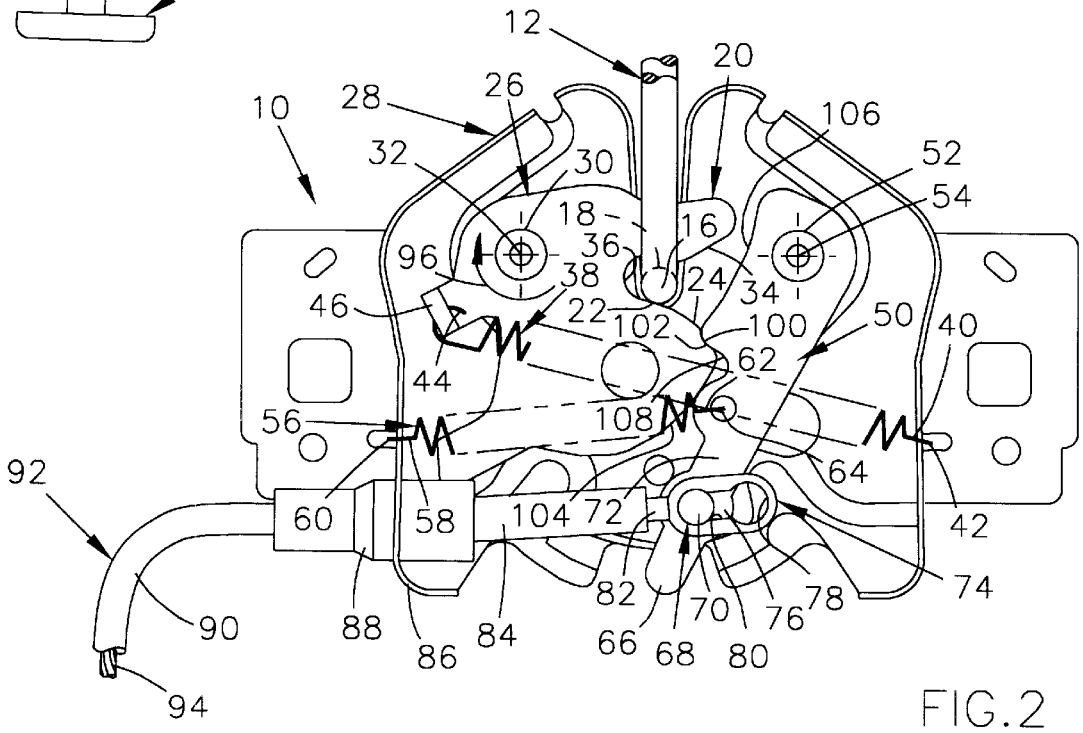
FIG. 2 is a view similar to that of FIG. 1 showing the latch mechanism in the fully engaged or fully locked position.
Figure 3:
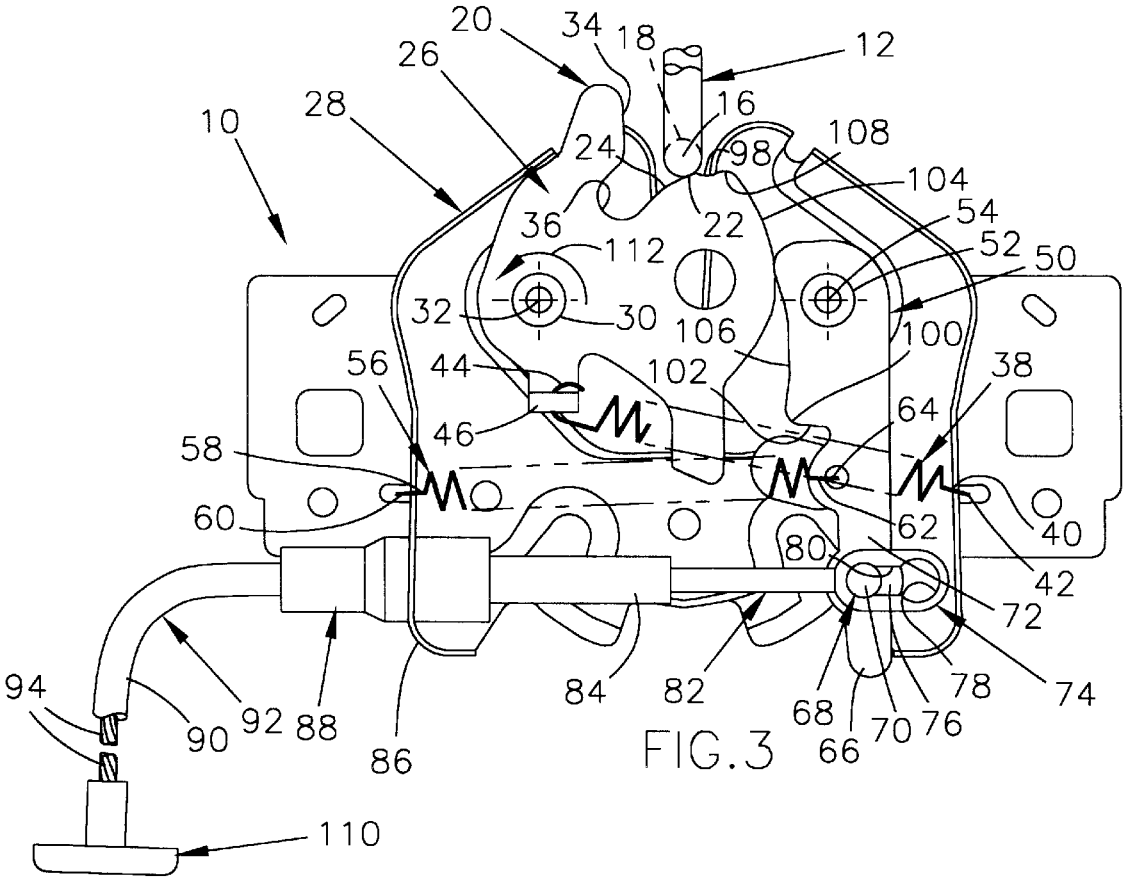
FIG. 3 is a view similar to that of FIGS. 1 and 2 showing the latch mechanism in the fully released or open position.

FIGS. 1 through 3 illustrate one aspect of the inventive latch mechanism. The latch mechanism 10 includes a striker 12 secured to the vehicle hood 14 and so positioned as to be moved in a substantially vertical portion of its arc of movement when the hood is raised or closed. Striker 12 is shown as a bar which may be either J-shaped with the longer end secured to the hood 14, or U-shaped with both ends secured to the hood 14. The bar may have various cross-section shapes, with a circular cross section being illustrated. In the particular construction of the striker shown in FIGS. 2 and 3, the U-shaped version is shown. In either instance, the reverse-bent portion 16 of the striker, shown in cross section in FIG. 1, is positioned to be able to have its inner (upper) surface 18 engaged by the latch mechanism bolt 20 in the latched position shown in FIG. 2. The reverse-bent portion 16 of the striker is also positioned to be disengaged by the bolt 20 and permit its outer (lower) surface 22 to follow a cam-like surface 24 on another part of the arm 26, of which the bolt 20 is a part, as the latch mechanism is released at least to a position wherein the outer (lower) surface 22 of the striker reverse-bent portion 16 is resting on a part of the surface 24 until the hood is raised further, and also when the hood is gently lowered to the ready-to-latch position of FIG. 1 but not moved downwardly sufficiently to cause the latch mechanism to be moved to its latched position. When the striker is in the released position, safety regulations require that a secondary latch be positioned to permit further opening of the vehicle hood until the secondary latch is separately actuated. Since this secondary latch mechanism and its release arrangement form no part of the present invention, they are not shown in the drawings.

The hood latch and release mechanism 10 includes a mounting bracket 28 which can be attached to a suitable part of the automotive assembly such as an automotive radiator support arm or bracket, not shown. The bolt latch and release arm 26 is pivotally mounted to bracket 28 by a suitable device such as a rivet, bolt or stud 30 which provides a pivot axis 32 for the arm 26. The bolt 20 is formed as a section of arm 26. It is shaped somewhat like a finger and extends generally in a radial direction from the arm pivot axis 32. Its side surface 34 joins surface 24 via the arcuate recess surface 36. Surface 34 is the portion of the bolt 20 which selectively engages the inner (upper) surface 18 of the striker 12 to lock the striker in place as shown in FIG. 2.

A tension spring 38 has one end 40 attached to the mounting bracket 28 at 42. The other spring end 44 is attached to a tang 46 formed on a portion of arm 26 that is substantially on the opposite side of axis 32 from bolt 20. Spring 38 continually urges the arm 26 toward rotation about axis 32 in a counter-clockwise direction as the arm is seen in FIGS. 1–3. Thus spring 38 is continually urging the bolt 20 toward its released but ready-to-latch position shown in FIGS. 3 and 1, respectively.

A bolt release lever So is pivotally mounted to bracket 28 by a suitable device such as a rivet, bolt or stud 52 which provides a pivot axis 54 for the lever 50. Another tension spring 56 has one of its ends 58 attached to a part of the mounting bracket 28 at 60 and its other end 62 attached to a part of lever 50 at attachment point 64. Attachment point 64 is spaced away from axis 52 so that the tension in spring 56 continually urges lever 50 to rotate in a clockwise direction as viewed in FIGS. 1–3.

The opposite end 66 of lever 50 from that lever's pivot axis 54 has a rivet or bolt 68 provided with an enlarged head 70 slightly spaced from the side 72 of the lever 50 so that it is readily received in the slotted connector 74. The slot 76 of connector 74 is keyhole shaped, with the larger slot end 78 being of a size to receive the enlarged head 70 and the linearly-extending smaller part 80 being smaller than the enlarged head 70 but slidably receiving the portion of the rivet or bolt 68 which supports the enlarged head 70 in spaced relation to the side 72 of the lever 50. Then tension of spring 56 acts to keep the rivet or bolt 68 in the end of the slot smaller part 80 opposite the larger slot end 78. However, lever 50 may be manually moved counterclockwise, as viewed in FIGS. 1–3, against the tension force of spring 56 so as to move the rivet or bolt 68 into the larger slot end 78, and then move the connector 74 laterally away from the arm side 72 to disconnect the rivet or bolt 68 and the arm end 66 from the connector 74.

A push rod or plunger 82 is reciprocally received in a swivel tube 84 which supports and guides the rod or plunger as lever 50 is moved arcuately about its pivot axis 54. Swivel tube 84 is mounted to a flange 86 of mounting bracket 28 by means of fitting 88 so that it may move with a relatively small swivel movement, yet sufficiently to accommodate the arcuate movements of arm end 66 without binding the rod or plunger 82. By way of example, the end of the swivel tube contained within the fitting 88 and the portion of that fitting receiving that swivel tube end may have a ball and socket arrangement. Alternatively, the swivel tube may be made of stiff yet somewhat flexible tubing which can flex slightly to accommodate the slight arcuate movements of the release lever causing the axis of the rod or plunger to be moved in a pivotal manner.

Fitting 88 has one end of the sheath 90 of a sheath and cable straud cable assembly 92 secured to it so that the one end of sheath 90 is also effectively secured to mounting bracket 28. Cable assembly 92 has a strand or cable 94 received therein with one end either attached to or in abutting relation with rod or plunger 82 so that, when the strand or cable is moved longitudinally within the sheath by being pushed on its other end, it moves rod or plunger 82 rightwardly as seen in FIGS. 1–3 from its position shown in FIGS. 1 and 2 to the position shown in FIG. 3. This rightward movement of rod or plunger 82 is obtained only in response to a longitudinally compressive force exerted on the other end of the strand or cable, pushing the strand or cable as will be later described. Such movement will move the end 66 of lever 50 rightwardly in an arc about axis 52 against the tension force exerted on lever 50 by spring 56. This longitudinally compressive force is imposed on strand or cable 94 by either of the structures shown respectively in FIGS. 4–7 and FIGS. 7–9. As will be later described this strand or cable compressive-force-induced movement of lever 50 will move the latching mechanism from the locked position to the released position.

However, if a tension force is exerted on the strand or cable 94 in some manner such as pulling generally laterally on an intermediate part of the cable assembly 92, no such releasing movement of lever 50 will occur. Even with the construction wherein the rod or plunger 82 is tightly secured to the adjacent cable or strand end, tension will at most simply be permitted by the lost-motion action of the slotted connector 74 and the bolt or rivet 68, with no releasing effect on the bolt release lever 50. This provides a theft-deterrent arrangement which prevents a potential thief from reaching in under the hood by hand or the use of a hooked tool and pulling laterally on the cable assembly until the tension so placed on the strand or cable will cause the latching mechanism to be released, as is possible in the typical cable or strand tension-releasing hood latch mechanisms that have been in common use for many years.

As seen in FIGS. 1–3, the striker 12 is moved downwardly from the position shown in FIG. 1 in order to close the hood 14 and lock it in its closed position. The outer (lower) surface 22 of the striker 12 engages the side surface 34 of arm 26, and acts on that surface as a cam driver, forcing arm 26 to rotate clockwise in the direction of arrow 96 against the tension force of spring 38 and moving the bolt 20 over the inner (upper) surface 18 of the striker 12 and holding the striker in the position shown in FIG. 2.

FIG. 2 shows the position of the various elements of the latch mechanism 10 once the hood 14 is closed and the striker 12 is locked in position to retain the hood against opening. The arm 26 has been rotated in the direction of arrow 96 until the notch 98 of side surface 34 has moved past the abutment 100 of the lever 50 and is engaged in locking relation with the surface 102 on the under side of abutment 100.

In the process of this movement of arm 26, the outer side surface 104 of arm 34 acts in camming relation against the side surface 106 of lever 50, causing that lever to be moved arcuately in a counter-clockwise direction sufficiently to permit the abutment 108, formed by the juncture of the upper end of arm 26 side surface 104 and the notch 98, to pass underneath the abutment 100 of lever 50. This counter-clockwise movement of the lever end 66 and the rivet or bolt 68 is permitted by the lost motion action accommodated by the slidable movement of the rivet or bolt 68 within the smaller part 80 of the connector slot 76 without causing any longitudinal movement of the push rod or plunger 82 or the cable or strand 94.

Once the abutment 108 has passed under the abutment 100, the tension in spring 56 moves the lever 50 in a clock-wise direction, positioning the abutment 100 further over the abutment 108 so that the notch 98 is in a position wherein the abutment 100 of lever 50 is received in the notch 98 in locking relation, preventing movement of the arm 26 in a counter-clockwise position. The hood latch mechanism 10 is then in the fully locked position shown in FIG. 2.

To release the latch mechanism 10, the vehicle operator pushes on the strand or cable 94 by actuating the hood latch and release control 110 schematically shown in FIG. 1. Either of the two particular arrangements shown in FIGS. 4–6 and 7–9 may be used as the hood latch and release control 110. This pushing action results in movement of the strand or cable 94 within the sheath 90 and a longitudinally compressive force being transmitted through the strand or cable which moves the rod or plunger 82 rightwardly as seen in FIG. 3, moving the lever 50 in a counter-clockwise direction against the tension force of spring 56 until abutment 100 is moved to permit abutment 108 be no longer be engaged with the under side 102, thus unlocking the lever 50 from the arm 26. The tension force of spring 38 immediately moves arm 26 in a counter-clockwise direction, opposite to the direction shown by arrow 96 of FIGS. 1 and 2 and in the direction of arrow 112 shown in FIG. 3, returning the arm 26 and its bolt 20 to the released position.

FIG. 3 shows the released position of lever 50 after release of the striker 12 has occurred, and before the compressive force exerted on the strand or cable 94 has been released. When the application of that compressive force has ceased, and there is no pushing action by hood latch and release control 110 on the strand or cable, spring 56 returns the lever 50 to the position shown in FIG. 1, and the mechanism is once again in the ready-to-latch condition. The force of spring 56 will be transmitted through lever 50 and rivet or bolt 68 as a compressive longitudinally-applied force acting rod or plunger 66 and strand 94 to provide a return force to the hood latch and release control 110 so that it is also in position to be pushed and release the latch mechanism once again after that mechanism has again been locked. This return force exerted by spring 56 and transmitted through rod or plunger 66 and strand 94 is preferably augmented by the torsional force of either a torsional spring shown in FIG. 5*a* or a compression coil spring shown in FIGS. 7–9. Those springs are described in detail below.

Figure 3A:
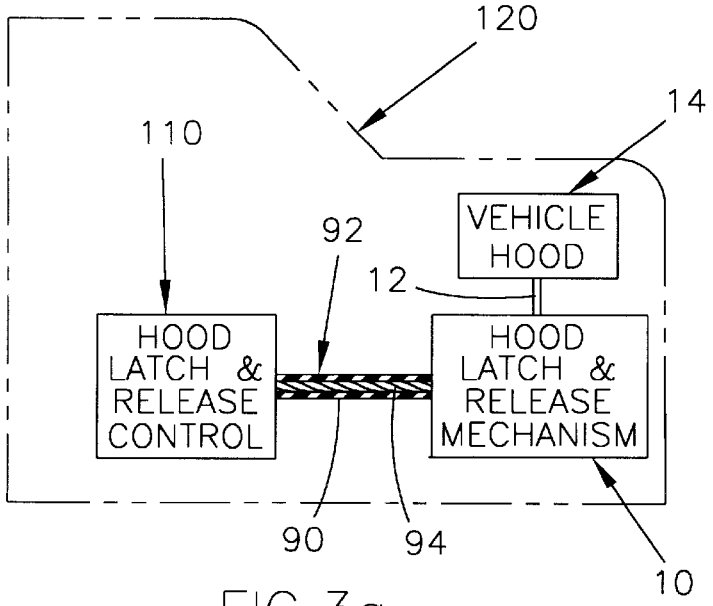
FIG. 3*a* is a schematic representation of the relationship of the vehicle hood and the hood latch and release mechanism of FIGS. 1–3 located in a vehicle, with the hood latch and release control of either FIGS. 4–6 or FIGS. 7–9.

FIG. 3*a* schematically represents the relationship between the vehicle 120 shown in dashed lines, the vehicle hood 14 and the hood striker 12, the hood latch and release mechanism 10, and the hood latch and release control 110. It schematically shows the cable assembly 92 with its sheath 90 and the strand or cable 94 connected to both the mechanism 10 and the control 110.

Figure 4:
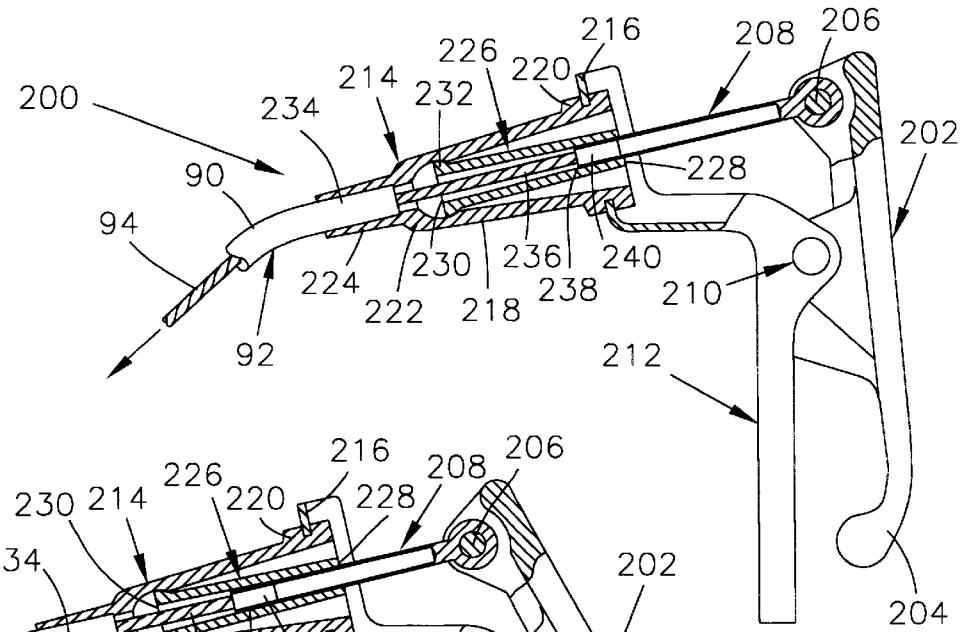
FIG. 4 is a cross section view, with parts broken away, showing one arrangement of the hood latch and release control, shown as a pivoting handle. It illustrates the handle end of the cable or strand with the latch mechanism being in the fully latched position of FIG. 2. The release handle mechanism shown in this
Figure 5:
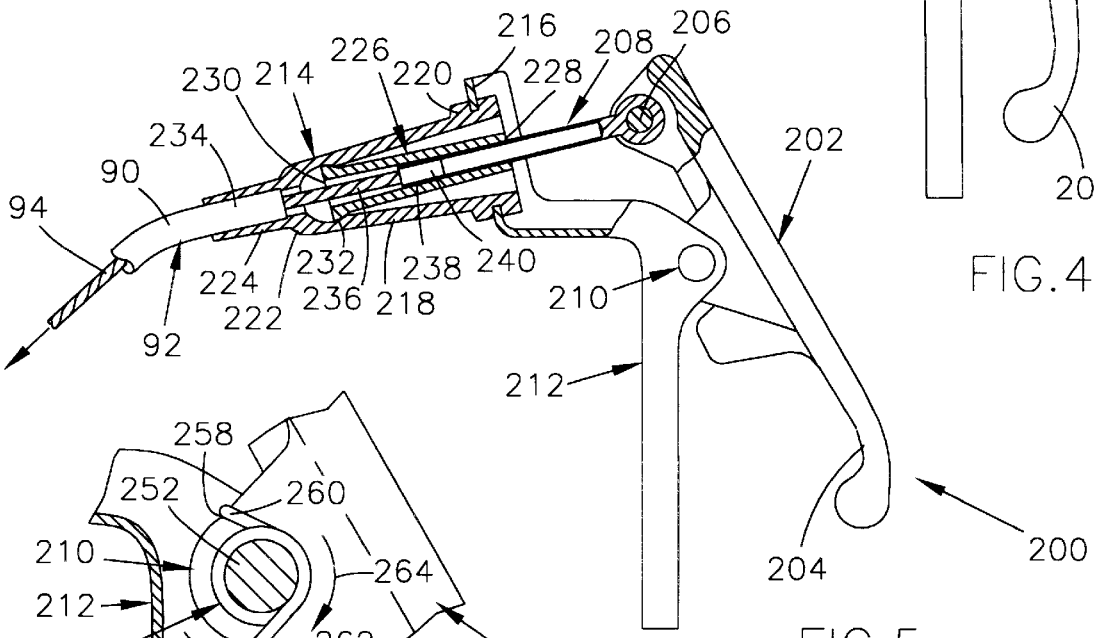
FIG. 5 is a cross section view similar to that of FIG. 4 showing the position of the hood latch and release control at the release handle end of the cable or strand with the hood latch mechanism in the released position shown in FIG. 3.
Figure 6:
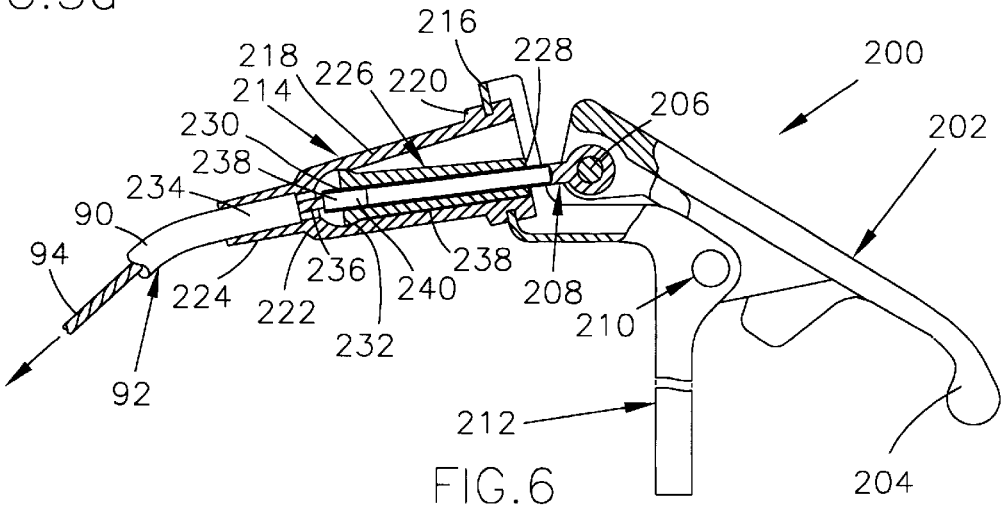
FIG. 6 is a cross section view similar to that of FIG. 5 showing the maximum stroke of the push-to-release action of the hood latch and release control at the release handle end of the cable or strand with the hood latch mechanism in the released position shown in FIG. 3.

Referring now to FIGS. 4–6 , a handle latch and release control mechanism 200 is shown for activating the hood release mechanism of FIGS. 1–3. The mechanism 200 is one form of the handle latch and release control 110 of FIGS. 1, 3 and 3*a*. A handle 202 has a section 204 arranged to be grasped by the hand of a vehicle operator, a pivot connection 206 to a push rod 208, and, at a location intermediate section 206 and pivot connection 208, a pivot connection 210 pivotally securing the handle to a fixed part 212 of the vehicle 120 in which the mechanism is installed. Handle 202 should be in such a position relative to the vehicle operator that it is easily reached, grasped and moved as progressively shown in FIGS. 4 and 5 to activate the hood release mechanism, as well as to be pivotally moved about pivot connection 210 to the position shown in FIG. 6. At the same time, it should be so located that it does not interfere with the normal operations of the vehicle 120 by the vehicle operator.

A support and guide member 214 is fixedly secured to the part 216 of the vehicle fixed part 212. It is generally tubular, and has a tapered tubular body 218 with the larger end 220 being the part of the body which is secured to the vehicle fixed part 212, 216. A tapered annular shoulder 222 joins the tubular body 218 with the smaller end 224 of 5 support and guide member 214. A tubular guide member 226 is fitted within the tapered tubular body 218. Member 226 has one open end 228 positioned within the larger end 220. Its other open end 230 is formed as an annular ball section 232 which fits within the shoulder 222 in a ball-and-socket relation. This permits the guide member 226 to be moved pivotally in a swivel-like manner within the tapered tubular body 218 as will be further described.

The sheath 90 of push-pull cable assembly 92 has its end 234 opposite the end thereof secured to fitting 88 received within the smaller end 224 of tubular support and guide member 214. The flexible cable or strand 94 of assembly 92 has its end 236 secured to the end 238 of rod 208 by a suitable manner such as the plug or button 240 fitting within rod end 236. When desired, instead of the plug or button, the rod 208 may be crimped so as to grip the end 236 of the cable or strand 94.

When the mechanism 200 is in the latched position shown in FIG. 4, handle 202 is positioned substantially parallel to the portion of vehicle body 212 on which it is pivoted at 210. The plug or button 240 and the flexible cable or strand end 236 are positioned in the immediate vicinity of the tubular body end 220. The mechanism 10 of FIGS. 1–3 is positioned in fully latched or locked position as shown in FIG. 2.

In order to actuate the mechanism 10 to release the hood striker 12, the vehicle grasps the handle part 204 and moves it to the position shown in FIG. 5, this movement being a pivotal movement about pivot 206. This exerts a longitudinally compressive force through the cable or strand 94, via pivot 206, rod 208 and plug or button 240, moving the mechanism 10 to the position shown in FIG. 1, removing the bolt 20 from its position holding striker 12 in the hood-closed position and allowing the striker to move upwardly from the position shown in FIG. 2 to the position shown in FIG. 1. Further movement of the handle part 204 to the full travel position shown in FIG. 6 moves the mechanism 10 to the position shown in FIG. 3. Upon the release of the handle part 204 by the vehicle operator, the tension force being exerted by spring 38 on the bolt release lever 50 moves the rivet or bolt 68 leftwardly in an arc from the position shown in FIG. 3 to the position shown in FIG. 1. This exerts a longitudinally compressive force through cable or strand 94 back to plug or button 240 and rod 208, moving the handle 202 back to the position shown in FIG. 4. The mechanism 10 is then in the position shown in FIG. 1, and the entire mechanism is again ready to latch the hood striker 12 in its downward position of FIG. 2 when the hood is closed, moving that striker downwardly as earlier described. It is to be understood that if the handle 202 is not moved past the position shown in FIG. 5 before it is released, it will be returned to the position shown in FIG. 4.

Figure 5A:
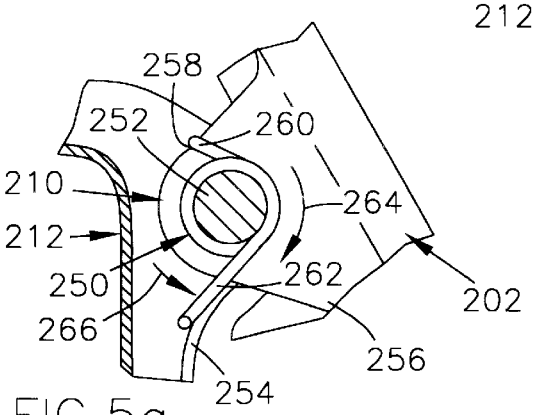
FIG. 5*a* is an enlarged portion of the control of FIGS. 5–7, shown with portions of the control in the position also illustrated in FIG. 5*a* and encircled with the dashed circle labeled 5*a*. Parts are broken away and in section.

FIG. 5*a* is a somewhat schematic fragmentary cross section view of the pivot connection 210 of the mechanism of FIGS. 4, 5 and 6, showing the torsion spring 250 which exerts a return force on the handle 202. As earlier noted, this spring, in conjunction with spring 56 of FIGS. 1–3, exerts a return force on the handle 202 so that, when the handle is released by the vehicle operator, the handle returns to the position shown in FIG. 4. Torsion spring 250 is wound about the pivot bar 252 which is a part of pivot connection 210. The fixed part 212 of the vehicle 120 is schematically shown as having a flange section 254, and the handle 202 has a mounting ear 256 through which the pivot bar 252 extends, permitting the ear 256 to rotate in arcuate directions about the pivot bar as illustrated in FIGS. 4–6 . Ear 256 has a notch 258 receiving a hooked end 260 of torsion spring 250. The other end 262 of torsion spring 250 is in engagement with flange section 254, and is prevented by that flange section from moving to unwind the torsion spring from that end. The winding and the installed spring tension of spring 250 is such that spring end 260 is urged clockwise and spring end 262 is urged counterclockwise as respectively indicated by arrows 264 and 266. Since flange section 254 does not permit such movement of spring end 262, any spring end movement caused by the spring tension in spring 250 will move spring end 260 in the direction indicated by arrow 264 when the handle 202 is released from either its positions shown in FIG. 5 and FIG. 6, moving the mounting ear 256 pivotally about the pivot bar 252 in the direction of arrow 264, causing the handle 202 to move clockwise as seen in FIGS. 8 and 9 and return to the position shown in FIG. 7.

Figure 7:
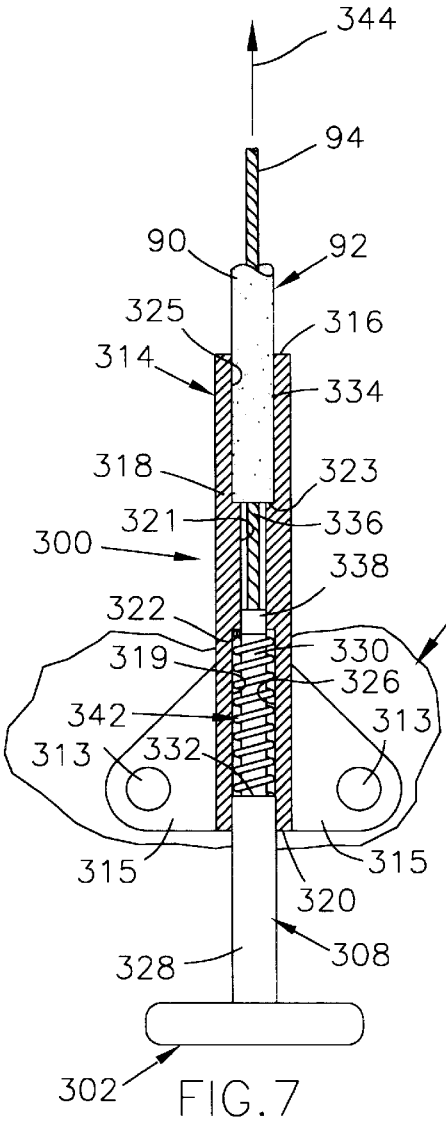
FIG. 7 is a cross section view of another hood latch and release control at the release handle end of the cable or strand with the hood latch mechanism being in the fully latched position of FIG. 2. The mechanism shown in this
Figure 8:
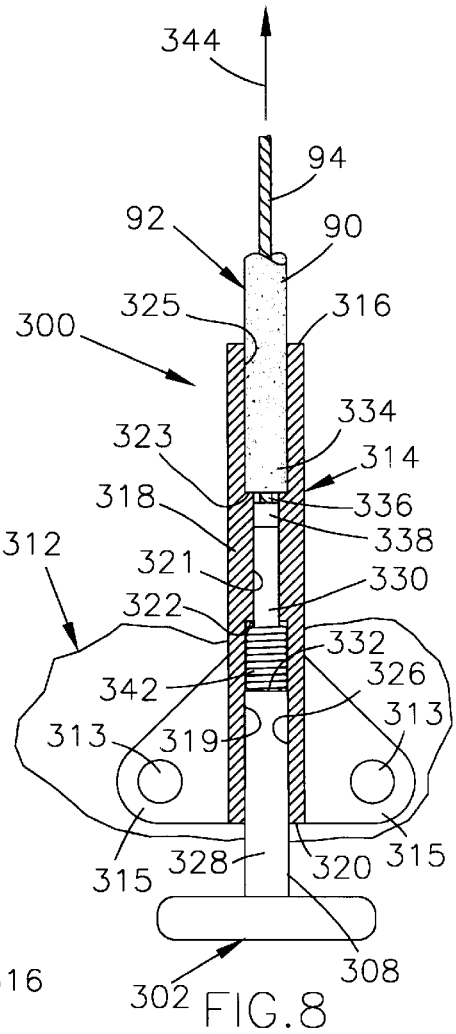
FIG. 8 is a cross section view similar to that of FIG. 7 showing the position of the hood latch and release control at the release handle end of the cable or strand with the hood latch mechanism in the released position shown in FIG. 3.
Figure 9:
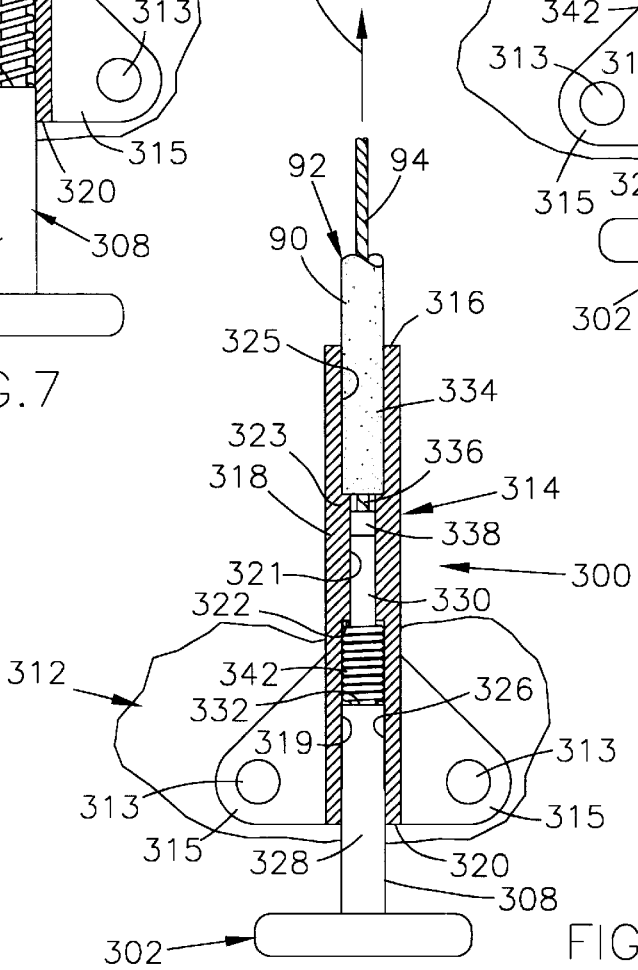
FIG. 9 is a cross section view similar to that of FIG. 8 showing the maximum stroke of the push-to-release action of the hood latch and release control at the release handle end of the cable or strand with the hood latch mechanism in the released position shown in FIG. 3.

The mechanism 300 shown in FIGS. 7, 8 and 9 is another modification of the hood latch and release control 110. It is illustrated in the same positions as respectively shown in FIGS. 4, 5 and 6. Essentially, the pivoting handle 202 is replaced by a handle 302 fixed to the rod 308, with the rod being movable inwardly and outwardly from and between the positions shown in FIG. 7 to FIG. 8, FIG. 8 to FIG. 9, and FIG. 9 to FIG. 7. If the handle 302 is not moved past the position shown in FIG. 8 before it is released, it will be returned to the position shown in FIG. 7 by either or both of the forces of tensions spring 56 and the coil spring Handle 302 should be in such a position relative to the vehicle operator that it is easily reached, grasped and moved as progressively shown in FIGS. 7 and 8 to activate the hood release mechanism, as well as to be moved to the position shown in FIG. 9. At the same time, it should be so located that it does not interfere with the normal operations of the vehicle by the vehicle operator.

A support and guide member 314 is fixedly secured to the vehicle fixed part 312 by rivets or bolts 313 or suitable other fastening means. It is generally tubular, having a tubular body 318 with one open end 316 and another open end 320. It has mounting flanges 315 through which the rivets or bolts 313 extend. If mounted by spot welding, for example, the welds would be between flanges 315 and the vehicle fixed part 312. An annular shoulder 322 formed within the tubular body 318 separates the tubular body into a larger diameter part 319 and a smaller diameter part 321. Another shoulder 323 near the open end 316 of tubular body 318 separates the smaller diameter part 321 and a slightly larger diameter part 325. The larger diameter part 325 is located near the open end 316 of tubular body 318. Tubular body parts 319 and 321 and the shoulder 322 define a guide cylinder 326. Push rod 308 has a larger diameter part 328 positioned within the tubular body larger diameter part 320 and a smaller diameter part 330 positioned within the tubular body larger diameter part 320. The shoulder 332 joining push rod parts 328 and 330 and the shoulder 322 in guide cylinder 326 receive opposite ends of a compression spring 342 which continually urges the two shoulders apart.

The sheath 90 of push-pull cable assembly 92 has its end 334 opposite the end thereof received within the slightly larger diameter tubular body part 325 of tubular support and guide member 314. The flexible cable or strand 94 of assembly 92 has its end 336 secured to the end 338 of rod 308 by a suitable manner such as crimping the rod to the end 336 or using a plug or button as earlier described for FIGS. 3–6. Thus, when the vehicle operator pushes on handle 302, rod 308 is moved inwardly, compressing spring 342 and exerting a longitudinally compressive force on cable or strand 94, moving that cable or strand axially, as indicated by arrow 344, toward the mechanism 10 to which it is connected as seen in FIGS. 1–3.

In order to actuate the mechanism 10 to release the hood striker 12 with the mechanism 300 of FIGS. 7, 8 AND 9, the vehicle operator grasps the handle part 302 with in the position shown in FIG. 7 and pushes it to the position shown in FIG. 8, this movement being a linear sliding movement toward tubular body open end 316. This exerts a longitudinally compressive force through the cable or strand 94, via push rod 308 and its connection with the cable or strand end 94, so that the compressive force being exerted by the vehicle operator moves the mechanism 10 to the position shown in FIG. 1, removing the bolt 20 from its position holding striker 12 in the hood-closed position and allowing the striker to move upwardly from the position shown in FIG. 2 to the position shown in FIG. 1. Further compressive movement of the handle 302 to the full travel position shown in FIG. 9 moves the mechanism 10 to the position shown in FIG. 3.

Upon the release of the handle 302 by the vehicle operator, whether it is in the position shown in FIG. 2 or the position shown in FIG. 3, the tension force being exerted by spring 38 on the bolt release lever 50 moves the rivet or bolt 68 leftwardly in an arc from the position shown in FIG. 2 or 3 to the position shown in FIG. 1. This exerts a longitudinally compressive force through cable or strand 94 back to plug or button 240 and rod 208, moving the handle 302 back to the position shown in FIG. 7. At the same time, compression spring 342 is exerting a similar force which also urges the handle 302 back to the position shown in FIG. 7. The mechanism 10 is then in the position shown in FIG. 1, and the entire mechanism is again ready to latch the hood striker 12 in its downward position of FIG. 2 when the hood is closed, moving that striker downwardly as earlier described. It is to be understood that if the handle 302 is not moved past the position shown in FIG. 8 before it is released, it will be returned to the released/ready to latch position shown in FIG. 7.

What is claimed is:

1. A vehicle engine compartment hood latching and releasing and control mechanism (10) for a vehicle having a passenger compartment, an engine compartment and an engine compartment hood normally closing the engine compartment, said vehicle engine compartment hood latching and releasing and control mechanism, when installed in such vehicle, preventing unauthorized hood releasing action of said mechanism by a pulling force externally exerted on a part of said vehicle engine compartment hood latching and releasing control mechanism, said mechanism comprising:

a hood latching and releasing portion (26, 28, 38, 50, 56, 68,) for latching and releasing the vehicle hood (14), including a hood latching striker (12) adapted to be secured to the vehicle hood and, when latched by said hood latching and releasing portion so that the vehicle engine compartment is closed by the hood, preventing opening of the hood by unauthorized operation of the releasing portion of said hood latching and releasing portion from the exterior of the vehicle, said hood latching and releasing portion having one position wherein said hood striker and therefore the vehicle engine compartment hood is latched in a hood closed position and another position wherein said hood striker and therefore the vehicle engine compartment hood is released from being latched so as to permit opening the vehicle engine compartment by authorized opening movement of the vehicle engine compartment hood, said hood latching and releasing and control mechanism also having a hood releasing control portion (92, 94, 110; 200; 300) having control means (202, 302, 208, 308,) for controlling the releasing action of said hood latching and releasing portion including a hood latching and releasing device, said hood releasing control portion being adapted to be mounted in the vehicle passenger compartment for ready operation by a vehicle operator;

said hood latching and releasing portion other than said hood striker being adapted to be mounted within the vehicle engine compartment on a fixed portion of the vehicle (120) relative to which the hood (14) is movably mounted for vehicle engine compartment opening and closing movements;

said hood latching and releasing portion including a cable assembly (94) having a cable strand (92) and a cable sheath (90) in which said cable strand is longitudinally movable when subjected to longitudinally acting compression forces, one end of said cable strand being secured to said control means for activation by a vehicle operator;

said hood striker being adapted to be secured to the hood and, when the hood with said hood striker is so movably mounted on the vehicle, being positioned in selectively latched and released relation to said hood latching and releasing device, said hood latching and releasing device being operatively responsive only to a longitudinally compressive force being selectively exerted through said cable strand of said hood releasing control portion of said mechanism to release said hood striker and therefore the hood from the hood latching condition; said hood releasing control portion of said mechanism being actuatable by said control means for selectively applying such longitudinally compressive force to said hood latching and releasing portion, said control means being accessible for hood releasing operation only from the vehicle passenger compartment when said mechanism is installed on the vehicle;

said latching and releasing and control mechanism having a lost-motion connector (74, 76, 78, 80, 82) connected to the other end of said cable strand and to said hood latching and release device and acting to permit only longitudinally acting compressive forces to be imposed upon and transmitted through said cable strand between said control means and said hood latching and release device;

said lost-motion connector, by being positioned between said other end of said cable strand and said hood latching and release device, effectively preventing any releasing action of said hood latching and release device by any exterior pulling force exerted on said cable assembly from underneath the engine hood while the engine hood is closed.

2. The vehicle engine compartment hood latching and releasing and control mechanism (10) for latching and releasing a vehicle engine compartment hood as set forth in claim 1 wherein said hood latching and release portion (26, 28, 38, 50, 56, 68, 74) further includes:

a housing (86) adapted to be operatively secured to a vehicle engine compartment fixed part of the vehicle of which the vehicle hood is a ((movable)) movable part;

latch bolt (20) biased by a first spring and being pivotally mounted on said housing and adapted to be latched to said hood striker (12) and to be unlatched therefrom and being spring biased by said first spring to be unlatched from said hood striker;

a latch bolt locking and release lever biased by a second spring and being (50) pivotally mounted on said housing for arcuate movements between a first arcuate position wherein said latch bolt locking and release lever engages said latch bolt with said latch bolt in its hood striker unlatched position and a second arcuate position wherein said lever is engaged by said latch bolt and locks said latch bolt in its hood striker latched position and beyond said second arcuate position to a third arcuate position wherein said bolt locking and release lever is disengaged from said latch bolt;

said lost-motion connector more specifically being operatively connected to said latch bolt locking and releasing lever of said hood latching and releasing device;

said control means having a part (212, 216; 314, 318) adapted to be fixed to the vehicle so as to be a fixed Part of said control means;

said cable sheath having first and second ends, said first end being operatively secured to said housing and said second end being adapted to be operatively secured to said fixed part of said control means and said cable strand having its said one end operatively secured to said control handle;

said hood releasing control portion of said hood latching and releasing and control portion including:

a control handle (202, 302) movably mounted relative to said control means fixed Darts and said sheath second end and being manually actuatable to act through said cable strand to operatively move said bolt locking and release lever from said second position to said third position against the force of said second spring biasing action thereon so that said latch bolt is released from locking engagement with said bolt locking and release lever;

said control handle acting only by manual operation thereof to exert compressive longitudinal force on said cable strand to said bolt locking and release lever when moved from said lever second position to said lever third position and only to receive compressive longitudinal force from said bolt locking and release lever through said cable strand when that lever is moved by said second spring biasing action from one of said second and third lever positions to said first lever position, with no tension force being exerted through said cable strand during either of such movements.

3. The vehicle engine compartment hood latching and releasing and control mechanism (10) for latching and releasing a vehicle engine compartment hood as set forth in claim 1 wherein said hood latching and releasing portion has a fixed housing (86) and said hood releasing control portion further comprises:

a latch bolt (20) biased by a first spring and being pivotally mounted on said housing and adapted to be latched to said hood striker (12) and to be unlatched therefrom and being spring biased by said first spring to be unlatched from said hood striker;

a latch bolt locking and release lever biased by a second spring and being (50) pivotally mounted on said housing for arcuate movements between a first arcuate position wherein said bolt locking and release lever engages said latch bolt with said latch bolt in its hood striker unlatched position and a second arcuate Position wherein said lever is engaged by said latch bolt and locks said latch bolt in its hood striker latched position and beyond said second arcuate position to a third arcuate position wherein said bolt locking and release lever is disengaged from said latch bolt;

a generally tubular control means housing (218, 318) adapted to be secured to a fixed part of the vehicle in the vehicle passenger compartment;

said cable sheath having first and second ends, said cable sheath first end being operatively secured in one end of said control means housing, said cable strand having first and second ends, said cable strand first end being connected to said lost-motion connector with said lost-motion connector providing a lost-motion connection between said cable strand one end and said bolt locking and releasing lever, and said cable strand second end extending through said cable sheath first end into said control means housing;

a control handle (202; 302) movably mounted on said control means housing and manually actuatable to exert longitudinally compressive force through said strand and said lost motion connector to operatively move said bolt locking and release lever from said second position to said third position against the force of said second spring biasing action thereon so that said latch bolt is released from locking engagement with said bolt locking and release lever;

said cable assembly sheath having its second end operatively secured to said hood latching and releasing portion fixed housing (86) and said cable assembly strand having its second end operatively secured to said control handle;

said control handle acting only to exert compressive longitudinal force on said cable strand to said bolt locking and release lever through said lost-motion connector when said bolt locking and release lever is moved from said lever second position to said lever third position and only to receive compressive longitudinal force from said bolt locking and release lever through said cable strand when that lever is moved by said second spring from one of said second and third lever positions to said first lever position and exerts such compressive longitudinal force through said lost-motion connector.

4. The engine compartment hood latching and releasing and control mechanism (10) of claim 2 in which said control handle (202; 302) is adapted to be pivotally mounted on a fixed part (212) of the vehicle in a position within the vehicle passenger compartment accessible to the vehicle operator and pivotally moved from a first pivotal position to a second pivotal position and to a third pivotal position and being operatively connected to said cable strand second end to cause said cable strand to be moved in said sheath by longitudinally compressive force as aforesaid.

5. The engine compartment hood latching and releasing and control mechanism (10) of claim 2 in which said control handle (302) is adapted to be mounted on a fixed part (312) of the vehicle in a position within the vehicle passenger compartment so as to be accessible to the vehicle operator and so as to be pushed by the vehicle operator for longitudinally linear movement in alignment with said cable strand second end from a first longitudinal position to a second longitudinal position and to a third position and being operatively connected to said cable strand second end and, when so pushed, to exert longitudinal compressive force on said cable strand and cause said cable strand to be moved in said sheath by longitudinally compressive force as aforesaid.

6. An arrangement preventing the opening of an engine compartment hood from within and underneath the engine compartment by tension applied to a flexible cable assembly portion of a hood latching and releasing and control mechanism, said arrangement comprising:

an engine compartment hood latching and releasing and control mechanism comprising:

a mechanism housing;

a control handle;

a flexible sheathed cable assembly having oppositely disposed first and second cable assembly ends, said cable assembly including a cable sheath having oppositely disposed first and second cable sheath ends, one of said cable sheath ends being secured to said mechanism housing, and a cable strand longitudinally movable in said cable sheath and having oppositely disposed first and second cable strand ends, said first cable strand end being connected to said control handle, said cable assembly being vulnerable to a pulling tension action on the parts thereof between said first and second cable assembly ends;

an over-center-action hood latching and releasing portion having a latched position and a released position, each of said positions being maintained in one or the other of said positions by said over-center-action hood latching and releasing portion and including:

a hood latch latching portion;

a hood latch releasing portion and a lost-motion connector having said second cable strand end connected thereto, said lost-motion connector operably connecting said second cable strand end with said hood latch releasing portion to actuate said hood latch releasing portion only by compressive force exerted by said control handle through said cable strand assembly, said lost-motion connector further operably acting to transmit a hood-latching force from said hood latch latching portion compressively through said strand to return said handle to its hood-latching position;

wherein said lost-motion connector and said cable strands being responsive only to compressive forces exerted therethrough to actuate said hood latch releasing portion being means to prevent hood latch releasing action of said hood latch releasing portion with any pulling tension force exerted either longitudinally or laterally on said cable assembly or said cable strand.

* * * * *